US010752435B2

(12) United States Patent
Onken, Jr. et al.

(10) Patent No.: US 10,752,435 B2
(45) Date of Patent: Aug. 25, 2020

(54) GREASE CONTAINER

(71) Applicants: Donald R Onken, Jr., Easton, IL (US); David A Hull, Mason City, IL (US)

(72) Inventors: Donald R Onken, Jr., Easton, IL (US); David A Hull, Mason City, IL (US)

( * ) Notice: Subject to any disclaimer, the term of this patent is extended or adjusted under 35 U.S.C. 154(b) by 0 days.

(21) Appl. No.: 15/446,638

(22) Filed: Mar. 1, 2017

(65) Prior Publication Data

US 2018/0251294 A1 Sep. 6, 2018

(51) Int. Cl.
*B65F 1/16* (2006.01)
*B65F 1/12* (2006.01)

(52) U.S. Cl.
CPC ..... *B65F 1/1607* (2013.01); *B65F 1/122* (2013.01); *B65F 2210/132* (2013.01); *B65F 2210/148* (2013.01); *B65F 2240/152* (2013.01)

(58) Field of Classification Search
CPC ..... B65F 2240/142; B65F 1/1615; B65F 1/1607; B65F 1/02
See application file for complete search history.

(56) References Cited

U.S. PATENT DOCUMENTS 8,511,501 B2 8/2013 Onken, Jr. et al.
8,905,257 B2 12/2014 Brown et al.

FOREIGN PATENT DOCUMENTS

CA 2457660 * 8/2005

* cited by examiner

*Primary Examiner* — Andrew T Kirsch
*Assistant Examiner* — Don M Anderson

(57) ABSTRACT

Embodiments of the present invention provide a collection container having a cover affixed to the top of the collection container. A mouth opens through the cover permitting access to the interior of the collection container. A lidded enclosure surrounds the mouth, and a screen may be secured within the lidded enclosure to selectively permit access through the mouth while preventing theft of the contents of the collection container.

7 Claims, 2 Drawing Sheets

GREASE CONTAINER

CROSS-REFERENCE TO RELATED APPLICATIONS

None.

BACKGROUND OF THE INVENTION

The present invention generally relates to storage and disposal. More particularly, the present invention relates to a container for storage and disposal of food preparation by-products.

Food preparation in the restaurant, hospitality, and many other industries results in by-products in the form of used cooking oil, contaminated with fats, particulates, and other waste matter. It is known to store such oil, or grease, to be stored in semi-stationary collection containers, then transferred in bulk to third parties for filtration and recycling. The semi-stationary collection containers may be elevated to transfer their contents into a transportation vehicle. To prevent the indoor accumulation of noxious fumes and to facilitate access by transportation vehicles, such collection containers are stored outdoors.

The interior of a collection container may be gated by a cover, which may be openable, spanning the top opening of the collection container. A cover may provide a mouth through the cover, which may be openable, through which used oils may be deposited within the collection container. However, consequently, collection containers stored outdoors are susceptible to breaching and theft of their contents.

Collection containers may be constructed having features to prevent and deter theft while still permitting authorized access to the container contents for storage and transport. U.S. Pat. No. 8,511,501 to Onken, Jr. discloses a collection container having a locking cover permanently installed, wherein the cover further provides a mouth blocked by a meshed grating such that siphoning tools cannot be inserted through the mouth. U.S. Pat. No. 8,905,257 to Brown discloses a collection container having a cover installed, wherein the cover further provides a mouth which may be blocked by a removable grating. A bar may be affixed over the grating to lock it in place.

BRIEF SUMMARY OF THE INVENTION

Embodiments of the present invention provide a collection container having a removable screen. A cover may be rested upon the top of the collection container to cover the mouth of the container body. A mouth opens through the cover, providing an opening to the interior of the container body through the cover.

An enclosure, which may be constructed from the same material as the collection container, selectively permits access to the mouth as follows. The enclosure includes splash guards surrounding the sides of the mouth. A backboard is affixed near the rear end of the mouth vertically and laterally across the enclosure. A conveyance platform is affixed at the front end of the mouth laterally across the enclosure, inclined downwards towards the rear of the collection container. A lid is openably fastened to the rear end of the enclosure.

Embodiments of the present invention provide a screen removably affixable over the mouth within the enclosure. The screen may be a solid meshed plate having periodic openings through it. The bottom side of the screen may have a lock receiver. While the screen is secured within the enclosure, the screen may be locked to the enclosure by securing a locking device on the lock receiver.

Configurations of a mouth accessed through an enclosure according to embodiments of the present invention may permit a source container holding liquid content to be rested on the conveyance platform over the enclosure. Configurations of a screen secured within an enclosure according to embodiments of the present invention may permit liquid content to be conveyed into the collection container through the screen while the screen is secured within the enclosure. Embodiments of the present invention as disclosed herein may deter theft of liquid content from the collection container by several mechanisms.

DETAILED DESCRIPTION OF THE INVENTION

Figure 1:
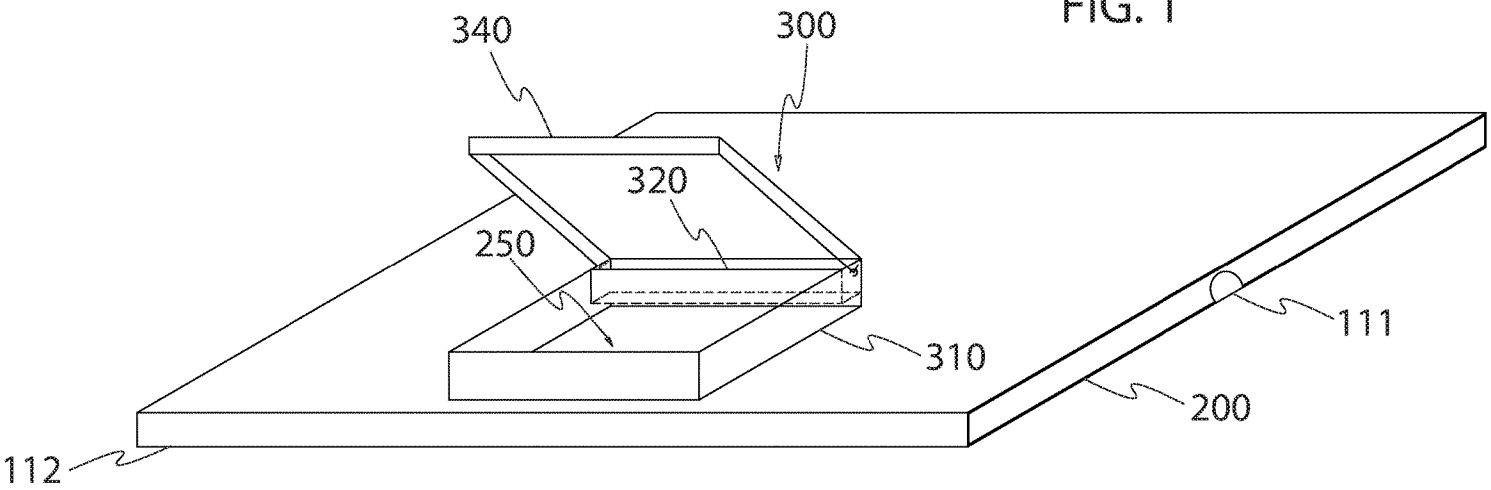
FIG. 1 illustrates a perspective view of a collection container cover according to an embodiment of the present invention.
Figure 2:
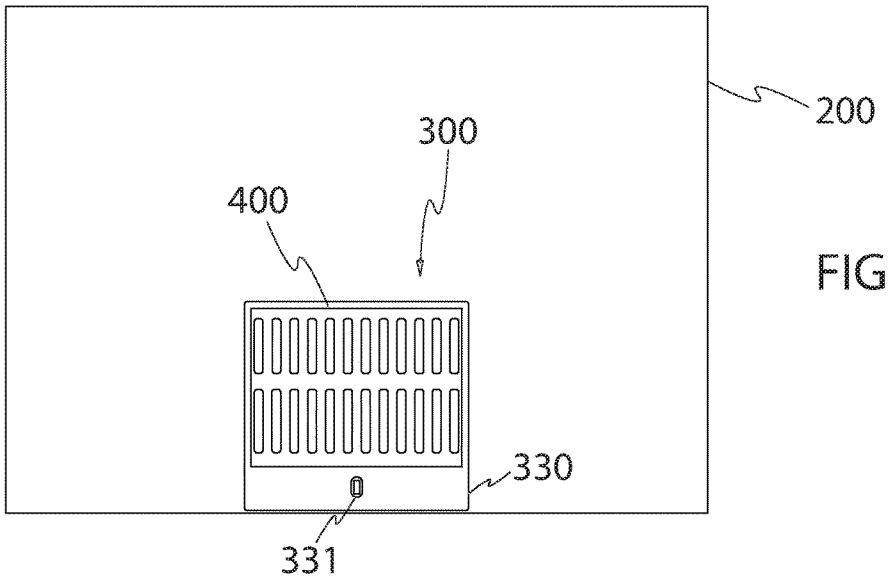
FIG. 2 illustrates a bottom view of the collection container cover of FIG. 1.
Figures 3, 4, 5:
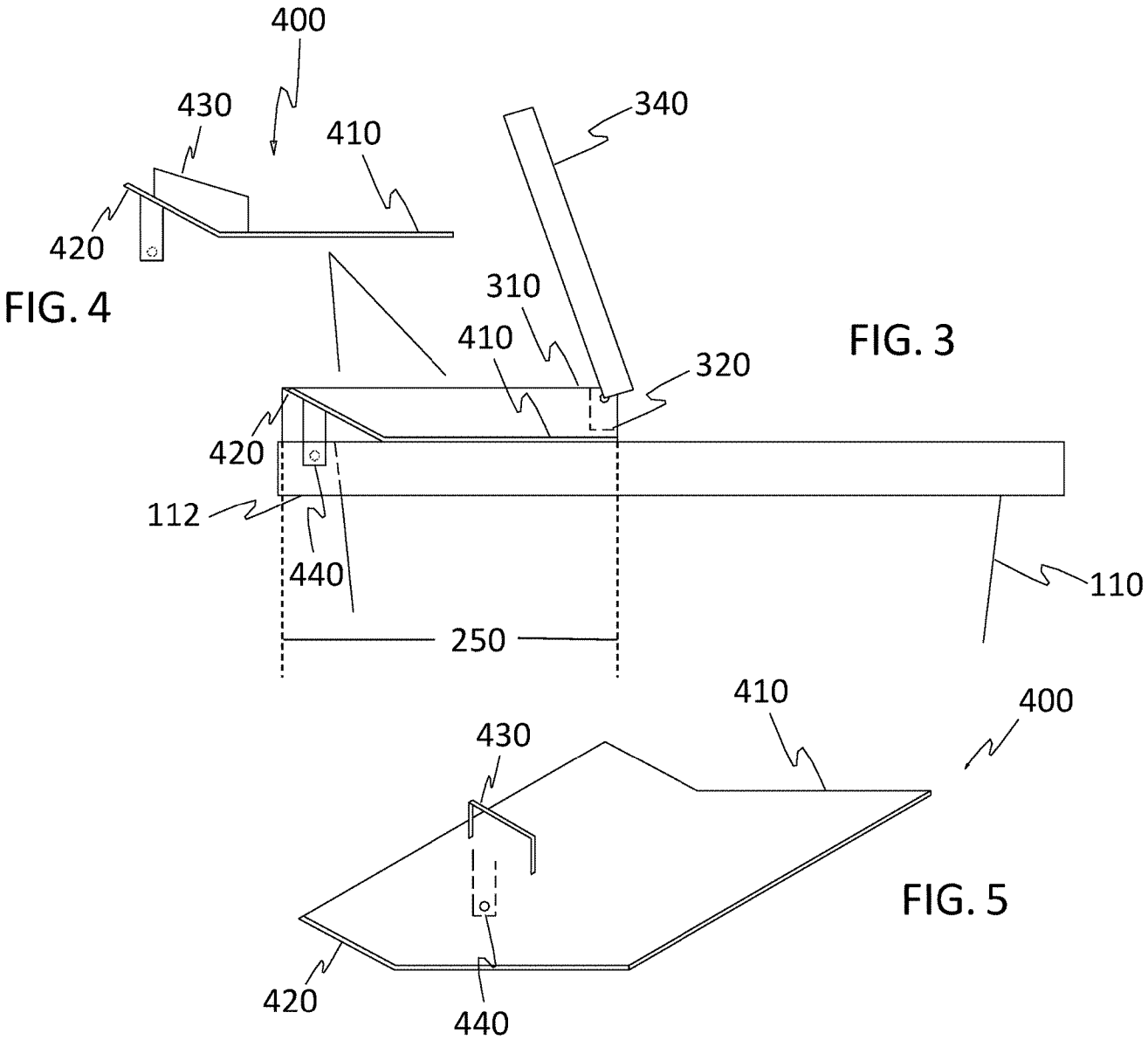
FIG. 3 illustrates a side view of the collection container cover of FIG. 1.
FIG. 4 illustrates a side view of a pour grating according to an embodiment of the present invention.
FIG. 5 illustrates a perspective view of the pour grating of FIG. 4.

FIG. 1 illustrates a perspective view of a collection container 100 according to an embodiment of the present invention. A container body 110 may be a conventional steel bin having a capacity ranging over approximately 100 to 300 gallons. The container body 110 may have anchor posts 111 abutting at opposing sides, such that a lifting apparatus may be affixed to the anchors to elevate the container body 110. A mouth through the top of the container body 110 accesses a chamber defined within the interior of the container body 110.

A cover 200 may be rested upon the top of the collection container 100 to cover the mouth of the container body 110. The cover 200 may be permanently affixed to the top of the collection container 100 by fasteners such as hinges on a side of the mouth of the collection container 100. A portion of the cover extends outward away from a front edge of the container body 110, forming an overhang 112. The other edges of the cover 200 may be substantially flush with the sides of the collection container 100, such that a prying tool such as a crowbar gains minimal leverage if inserted between the cover 200 and the mouth of the collection container 100.

A mouth 250 opens through the cover 200, providing an opening to the interior of the container body 110 through the cover 200. The mouth 250 may be adjacent to one side of the collection container 100, hereafter defined as the front side, to facilitate access. The mouth 250 may overlap with a portion of the overhang 112. An enclosure 300, which may be constructed from the same material as the collection container 100, selectively permits access to the mouth 250 as follows.

The enclosure 300 includes splash guards 310 surrounding the sides of the mouth 250. The splash guards 310 may block errant liquid while conveying liquid content into the collection container 100 through the mouth 250.

A backboard 320 is affixed near the rear end of the mouth vertically and laterally across the enclosure 300. The backboard 320 obstructs a portion of the clearance through the enclosure 300 over the mouth 250. The top edge of the backboard 320 may reach to the top of the enclosure 300, while the bottom edge of the backboard 320 may stop short of the bottom of the enclosure 300.

A conveyance platform 330 is affixed at the front end of the mouth laterally across the enclosure 300, inclined downwards towards the rear of the collection container 100. The conveyance platform 330 has a slot 331 opening through its approximate midpoint in a front-rear direction. The underside of the conveyance platform 330 may be accessible through the mouth 250 and through the overhang 112 from the underside of the overhang 112. The conveyance platform 330 provides a surface upon which a source container may be rested to convey liquid content from the source container into the collection container 100.

A lid 340 is openably fastened to the rear end of the enclosure 300. The lid 340 may have underhanging sides which surround the splash guards 310 while the lid 340 is closed.

Embodiments of the present invention provide a screen 400 removably affixable over the mouth 250 within the enclosure 300. The screen 400 may be a solid meshed plate having periodic openings through it, permitting liquids but not solid objects of substantial width to pass through. The screen 400 may be constructed from materials substantially resistant to common industrial cutting tools.

The screen 400 may have a level portion 410 and a sloped portion 420. The level portion 410 may be larger in area than the edges of the mouth 250. The top side of the screen 400 may have a handle 430 affixed thereto. The bottom side of the screen 400 may have a lock receiver 440 protruding below the sloped portion 420. A lock receiver 440 may be a structure which receives a conventional physical lock.

The screen 400 may be secured within the enclosure 300 by resting the screen 400 upon the conveyance platform 330 and sliding the screen 400 under the backboard 320. The level portion 410 may rest over the mouth 250 supported by the edges of the mouth 250. The sloped portion 420 may rest over the conveyance platform 330. The backboard 320 may secure the rear end of the screen 400 in place, while the front end of the screen 400 may be secured in place by inserting the lock receiver 440 through the slot 331.

While the screen 400 is secured within the enclosure 300, the screen 400 may be locked to the enclosure 300 by securing a locking device on the lock receiver 440. The locking device may be any conventional physical lock which prevents the lock receiver 440 from being retracted through the slot 331. Consequently, the screen 400 is secured at its rear end under the backboard 320 and at its front end by the locking device, ensuring it cannot be removed from the mouth 250.

Configurations of a mouth 250 accessed through an enclosure 300 according to embodiments of the present invention may permit a source container holding liquid content to be rested on the conveyance platform 330 over the enclosure 300, such that the source container may be tipped over the mouth 250 to convey liquid content from the source container into the collection container 100.

Configurations of a screen 400 secured within an enclosure 300 according to embodiments of the present invention may permit liquid content to be conveyed into the collection container 100 through the screen 400 while the screen 400 is secured within the enclosure 300. Moreover, the screen 400 while removed may facilitate emptying liquid content from the collection container 100 while the container body 110 is elevated.

Embodiments of the present invention as disclosed herein may deter theft of liquid content from the collection container 100. The cover 200 being set flush with the sides of the collection container 100 may prevent breaching the cover 200 using prying tools. The screen 400 being secured at its rear end by the backboard 320 and at its front end by a locking device through the lock receiver 440 may prevent breaching the mouth 250 using prying or cutting tools to cut or remove the screen 400, and may further prevent insertion of draining inlets to suction off the liquid contents of the collection container 100.

While particular elements, embodiments, and applications of the present invention have been shown and described, the invention is not limited thereto because modifications may be made by those skilled in the art, particularly in light of the foregoing teaching. It is therefore contemplated by the application to cover such modifications and incorporate those features which come within the spirit and scope of the invention.

What is claimed is:

1. A collection container comprising:

a. a container body;

b. a cover substantially flush with the sides of the container body;

c. a mouth opening through the cover;

d. an enclosure surrounding the mouth;

e. a conveyance platform affixed laterally across the enclosure and inclined downwards towards a rear of the collection container;

f. wherein the conveyance platform further comprises a slot opening disposed through it; and g. a screen comprising:

i. a plate comprising a level portion and a sloped portion;

ii. a lock receiver at the underside of the sloped portion configured to secure the screen within the enclosure;

iii. wherein periodic openings open through the level portion of the plate; and iv. wherein the screen may be secured within the enclosure to cover the mouth.

2. The container of claim 1, wherein a portion of the cover extends outward away from a front edge of the container body, forming an overhang and wherein the mouth opening of the cover partially overlaps the overhang such that an underside of the conveyance platform is accessible from the mouth opening and from an underside of the overhang.

3. The container of claim 2, where the enclosure further comprises splash guards, a backboard affixed laterally across the enclosure, a conveyance platform affixed laterally across the enclosure, and a lid.

4. The container of claim 3, wherein a slot opens through the conveyance platform.

5. The container of claim 4, wherein the screen is secured within the enclosure under the backboard at the rear end of the screen, and the screen is secured within the enclosure at the front end of the screen by inserting the lock receiver through the slot.

6. The container of claim 5, wherein the underside of the conveyance platform is accessible through the mouth and through the overhang from the underside of the overhang.

7. The container of claim 6, further comprising a locking device secured to the lock receiver at the underside of the overhang.

* * * * *